US009147540B2

(12) United States Patent
Lee

(10) Patent No.: US 9,147,540 B2
(45) Date of Patent: Sep. 29, 2015

(54) 3-WAY SWITCH FOR A GAS-INSULATED APPARATUS

(75) Inventor: Chul-Ho Lee, Ulsan (KR)

(73) Assignee: HYUNDAI HEAVY INDUSTRIES CO., LTD. (KR)

( * ) Notice: Subject to any disclaimer, the term of this patent is extended or adjusted under 35 U.S.C. 154(b) by 0 days.

(21) Appl. No.: 14/126,532

(22) PCT Filed: Feb. 21, 2012

(86) PCT No.: PCT/KR2012/001298

§ 371 (c)(1),
(2), (4) Date: Dec. 16, 2013

(87) PCT Pub. No.: WO2013/002472

PCT Pub. Date: Jan. 3, 2013

(65) Prior Publication Data

US 2014/0116859 A1 May 1, 2014

(30) Foreign Application Priority Data

Jun. 28, 2011 (KR) ..... 10-2011-0063221

(51) Int. Cl.
*H01H 33/42* (2006.01)
*H01H 31/00* (2006.01)
(Continued)

(52) U.S. Cl.
CPC ..... *H01H 33/42* (2013.01); *H01H 31/003* (2013.01); *H01H 31/32* (2013.01); *H01H 1/38* (2013.01); *H01H 33/64* (2013.01)

(58) Field of Classification Search
CPC . H01H 33/666; H01H 33/022; H01H 31/003; H01H 3/3031; H01H 3/3021; H01H 33/42; H01H 3/02; H01H 9/26; H02B 13/02
USPC ..... 218/45, 55, 79, 80, 154; 200/50.39, 200/51.06; 361/621
See application file for complete search history.

(56) References Cited

U.S. PATENT DOCUMENTS 5,721,412 A * 2/1998 Schifko et al. ..... 218/43
5,841,087 A * 11/1998 Fuchsle et al. ..... 218/45
(Continued)

FOREIGN PATENT DOCUMENTS

EP 2178099 4/2010
JP 10285729 10/1998
(Continued)

OTHER PUBLICATIONS

Machine translation of KR200321221 attached to Office Action.*
(Continued)

*Primary Examiner* — Renee S Luebke
*Assistant Examiner* — William Bolton
(74) *Attorney, Agent, or Firm* — Cantor Colburn LLP

(57) ABSTRACT

A 3-way switch for a gas-insulated apparatus includes a first connecting part and a second connecting part perpendicular to the first connecting part, a support conductor having a first guide hole perpendicular to the direction of the first connecting part and a second guide hole in parallel to the direction of the second connecting part, a disconnecting switch (DS) operating part slidably coupled to the first guide hole, an earthing switch (ES) operating part slidably coupled to the second guide hole such that the ES operating part is perpendicular to the disconnecting switch operating part, and a main lever, one end of which is rotatably coupled to the support conductor and the other end of which is eccentrically rotated and rotatably connected to the DS operating part and the ES operating part for linear sliding of the DS operating part and the ES operating part.

4 Claims, 5 Drawing Sheets

(51) Int. Cl.

| | |
|---|---|
| ***H01H 31/32*** | (2006.01) |
| ***H01H 1/38*** | (2006.01) |
| ***H01H 33/64*** | (2006.01) |

(56) References Cited

U.S. PATENT DOCUMENTS

| | | | | |
|---|---|---|---|---|
| 6,559,403 | B2 * | 5/2003 | Gutalj | 218/79 |
| 8,173,927 | B2 | 5/2012 | Treier | |
| 8,389,884 | B2 * | 3/2013 | Gelloz et al. | 200/335 |
| 2007/0068903 | A1 * | 3/2007 | Hashimoto et al. | 218/57 |
| 2012/0012449 | A1 * | 1/2012 | Shin et al. | 200/5 B |

FOREIGN PATENT DOCUMENTS

| | | |
|---|---|---|
| KR | 100347363 | 8/2002 |
| KR | 200321221 | 7/2003 |
| KR | 1020050098360 | 10/2005 |

OTHER PUBLICATIONS

International Search Report—PCT/KR2012/001298 dated Sep. 26, 2012.
Written Opinion—PCT/KR2012/001298 dated Sep. 26, 2012.
European Search Report—European Application No. 12803901.3 issued on Feb. 6, 2015.

* cited by examiner

3-WAY SWITCH FOR A GAS-INSULATED APPARATUS

TECHNICAL FIELD

The present invention relates to a current transformer mounting structure for a gas-insulated switchgear (GIS), and more particularly, to a 3-way switch for a gas-insulated apparatus capable of reducing a driving radius and size of a device by converting rotational motion into linear motion to achieve neutrality, disconnection switching, and earthing switching.

BACKGROUND ART

In general, a GIS includes a gas circuit breaker (GCB), a disconnecting switch (DS), an earthing switch (ES), a lightning arrester, and a main bus which are main components of a transformer substation. The GIS has internally excellent insulation performance and is filled with an inert sulfur hexafluoride (SF6) gas, thereby accommodating the size reduction and safety of the transformer substation.

Although the DS and the ES among the above-described devices perform open and close operations of a contact point using independent operating mechanisms, an integrated DS/ES operating mechanism capable of operating the DS and the ES with one operating mechanism because of simplification of a structure, economy, simplicity of control, etc. has recently been proposed.

The DS/ES operating mechanism of the related art connects a lever, a link, and ES/DS operating elements to a rotation axis using pins, and simultaneously moves the ES/DS operating elements during an operation.

However, because the GIS of the related art has a problem in that a size of a device increases when a driving radius of the device increases, there is a need for an operating method for solving the problem.

DISCLOSURE

Technical Problem

The present invention has been made to solve the above-described problem and an object of the invention is to provide a 3-way switch for a gas-insulated apparatus in which a main lever which rotatably moves according to an external force switches an operating part to linear motion to achieve neutrality, disconnection switching, and earthing switching, thereby reducing a driving radius and size of a device.

Technical Solution

One aspect of the present invention provides a 3-way switch for a gas-insulated apparatus, including: a pressure container having a space part therein, the pressure container including a first connecting part in an upper portion of the space part and a second connecting part in a side portion of the space part such that the second connecting part is perpendicular to the first connecting part; a support conductor provided in the space part, the support conductor having a first guide hole defined in a direction perpendicular to the direction of the first connecting part and a second guide hole defined in a direction parallel to the direction of the second connecting part; a DS operating part slidably coupled to the first guide hole, the DS operating part being connected to or separated from the first connecting part by means of an insertion or extrusion thereof; an ES operating part slidably coupled to the second guide hole such that the ES operating part is perpendicular to the disconnecting switch operating part, the ES operating part being connected to or separated from the second connecting part through an insertion or protrusion thereof; and a main lever, one end of which is rotatably coupled to the support conductor and the other end of which is eccentrically rotated and rotatably connected to the DS operating part and the ES operating part so as to linearly slide the DS operating part and the ES operating part into neutral positions.

Preferably, the DS operating part may have one end which is opposite to a direction of the first connecting part and rotatably connected to a first connecting lever, both ends of which are rotatably connected to the main lever, and the ES operating part may have one end which is opposite to a direction of the second connecting part and rotatably connected to a second connecting lever, both ends of which are rotatably connected to the main lever.

Preferably, the 3-way switch for the gas-insulated apparatus may further include: rotatable connecting rollers provided in connection portions between the first and second connecting levers and the main lever. Preferably, a rotation angle of the main lever may be 90°.

Preferably, the main lever may be coupled to one end of an insulation rod which is connected to an external operating machine and transfers a turning force, and the insulation rod may have one end of an axial direction coupled to the main lever in a state in which the one end is rotatably coupled to the support conductor and the other end rotatably coupled in a state in which the other end has passed through outside the pressure container.

Advantageous Effects

The present invention has an advantageous effect in that a main lever which rotatably moves switches an operating part to linear motion to achieve neutrality, disconnection switching, and earthing switching, thereby reducing a driving radius and size of a device.

MODES OF THE INVENTION

Figure 1A:
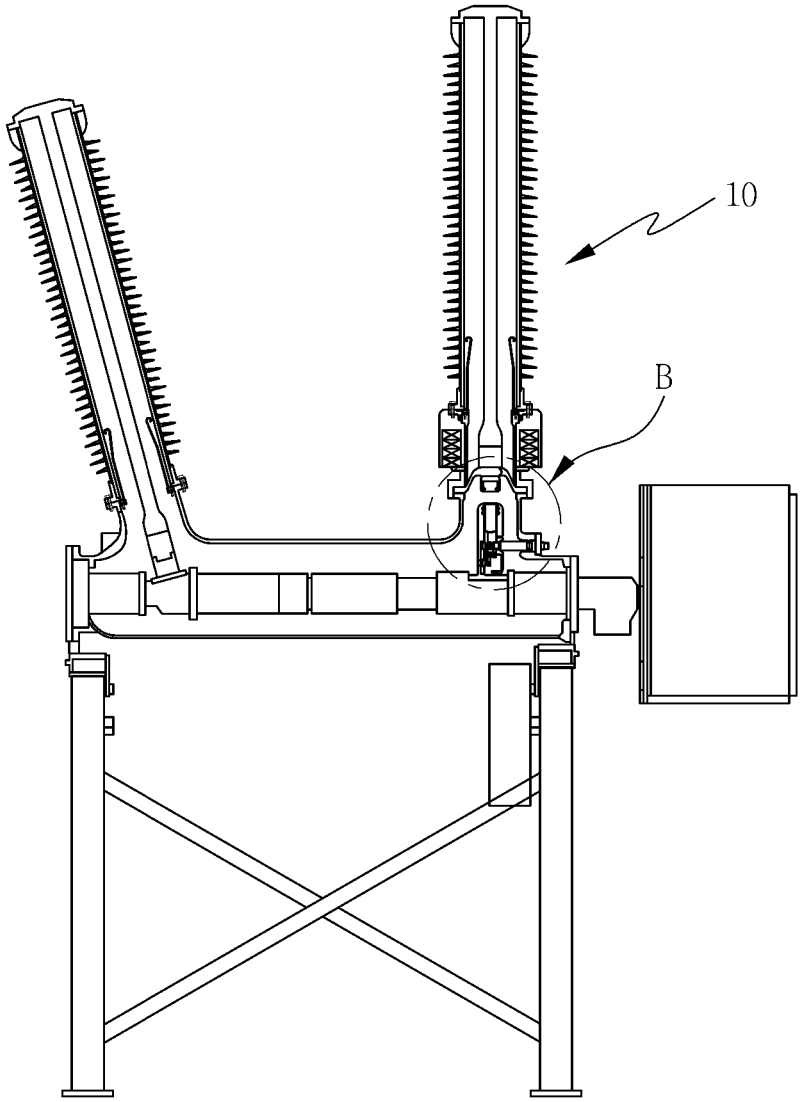
FIG. 1A is a diagram illustrating an installation state of a 3-way switch for a gas-insulated apparatus according to the present invention.
Figure 1B:
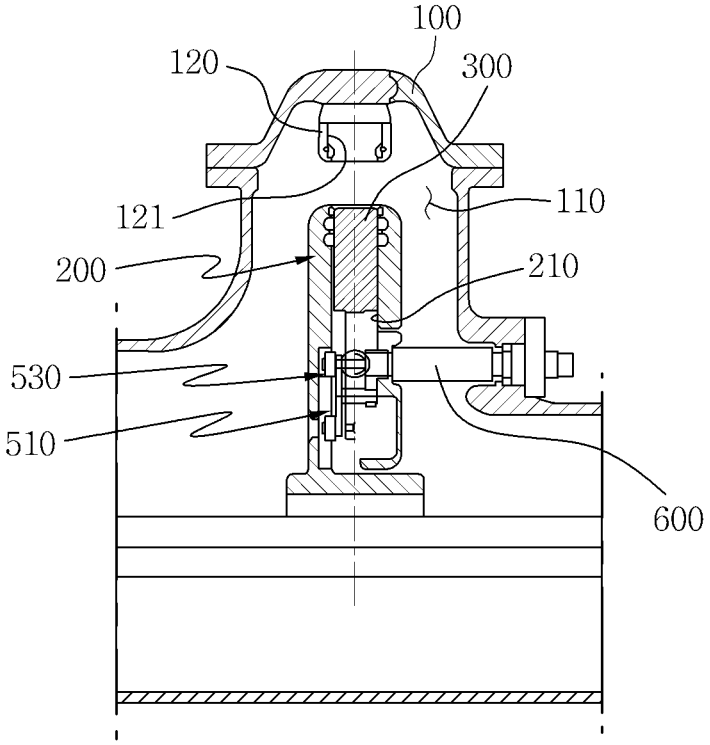
FIG. 1B is an enlarged view illustrating a circled portion marked by B in FIG. 1A.

Hereinafter, preferred exemplary embodiments of the present invention will be described in detail with reference to the accompanying drawings.

The terminologies used in the descriptions of the present invention are chosen based on the functions of corresponding elements of the present invention. Therefore, the terminologies used in the descriptions of the present invention are not committed to limit the technical elements of the present invention.

As illustrated in FIGS. 1A to 4, a 3-way switch for a gas-insulated apparatus according to the present invention is designed so that a main lever which rotatably moves switches an operating part to linear motion to achieve neutrality, disconnection switching, and earthing switching, thereby reducing a driving radius and size of a device.

For this, the 3-way switch for the gas-insulated apparatus according to the present invention includes a pressure container 100, a support conductor 200, a disconnecting switch (DS) operating part 300, an earthing switch (ES) operating part 400, and a main lever 500.

First, the pressure container 100 is fixedly installed in the gas-insulated apparatus 10, and a space part 110 is formed so that given pressure can be internally maintained. A first connecting part 120 is provided in an upper portion of the space part 110, and a second connecting part 130 is provided in a side portion of the space part 110 so that the second connecting part 130 is perpendicular to the first connecting part 120.

The first connecting part 120 has a lower end on which a first insertion groove 121 is formed so that one length-direction end of the DS operating part 300 to be described later can be inserted and connected, and the second connecting part 130 has a side end on which a second insertion groove 131 is formed so that one length-direction end of the ES operating part 400 to be described later can be inserted and connected. Here, the first connecting part 120 and the second connecting part 130 may be provided to project to the space part of the pressure container 100.

The support conductor 200 is fixedly provided in the space part 110. The support conductor 200 has a first guide hole 210 defined in a direction perpendicular to the direction of the first connecting part 120 and a second guide hole 220 defined in a direction parallel to the direction of the second connecting part 130.

The DS operating part 300 is vertically slidably coupled to the first guide hole 210 in a state in which the DS operating part 300 has been inserted within the first guide hole 210. The DS operating part 300 is opened and closed by the connection to or separation from the first connecting part 120 through an insertion into or extrusion from an upper portion of the first guide hole 210.

The ES operating part 400 is slidably coupled to the second guide hole 220 in a state in which the ES operating part 400 has been inserted into the second guide hole 220 such that the ES operating part 400 is perpendicular to the DS operating part. That is, the ES operating part 400 is opened and closed by the connection to or separation from the second connecting part 130 through an insertion into or extrusion from a side portion of the second guide hole 220.

Also, the DS operating part 300 has one end which is opposite to a direction of the first connecting part 120 and rotatably connected to one end of a first connecting lever 510 through a first rotatable connecting roller 530. The other end of the first connecting lever 510 is rotatably connected to the main lever 500.

The ES operating part 400 has one end which is opposite to a direction of the second connecting part 130 and rotatably connected to one end of a second connecting lever 520 through a second rotatable connecting roller 530'. The other end of the second connecting lever 520 is rotatably connected to the main lever 500.

In addition, the rotatable connecting rollers 530, 530' are provided in connection portions among the first connecting lever 510, the second connecting lever 520 and the main lever 500. It is preferable for a rotation angle of the main lever 500 to be 90°.

The main lever 500 has one end which is rotatably coupled to the support conductor 200 and the other end which is eccentrically rotated and rotatably connected to the DS operating part 300 and the ES operating part 400, as described above and shown in FIG. 2.

Figure 2:
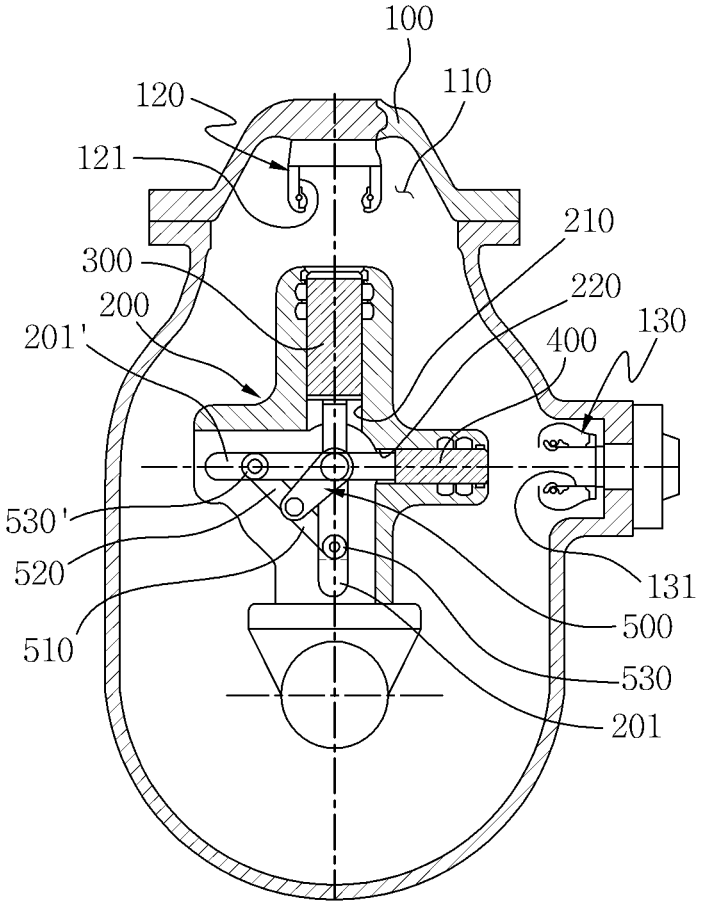
FIG. 2 is a front sectional view illustrating a neutral state of the 3-way switch for the gas-insulated apparatus according to the present invention.
Figure 3:
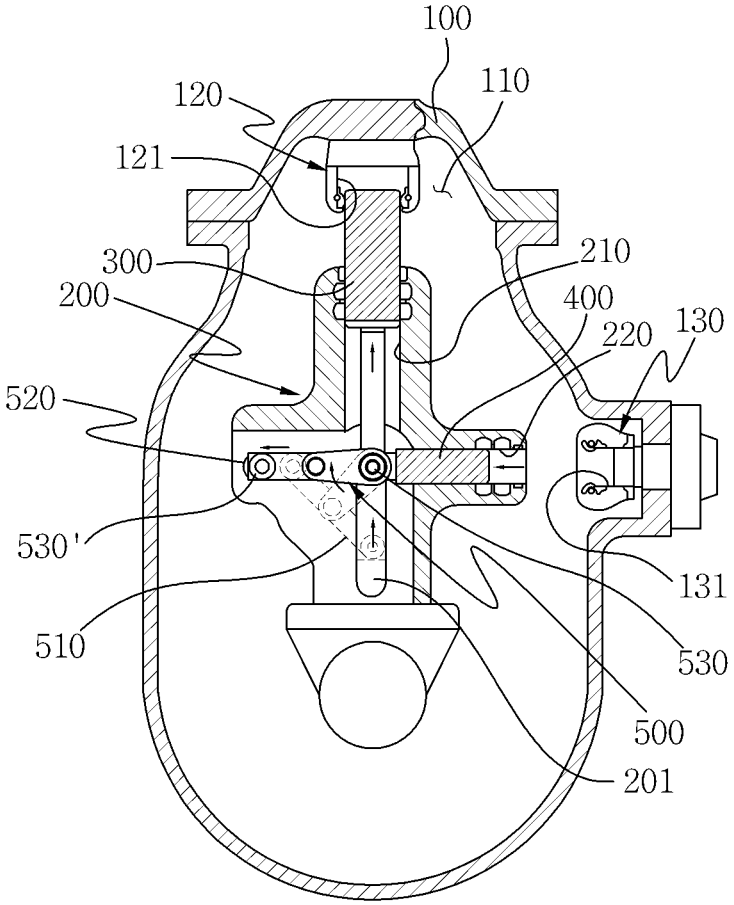
FIG. 3 is a first operating state diagram illustrating a disconnecting switch coupling state of the 3-way switch for the gas-insulated apparatus according to the present invention.
Figure 4:
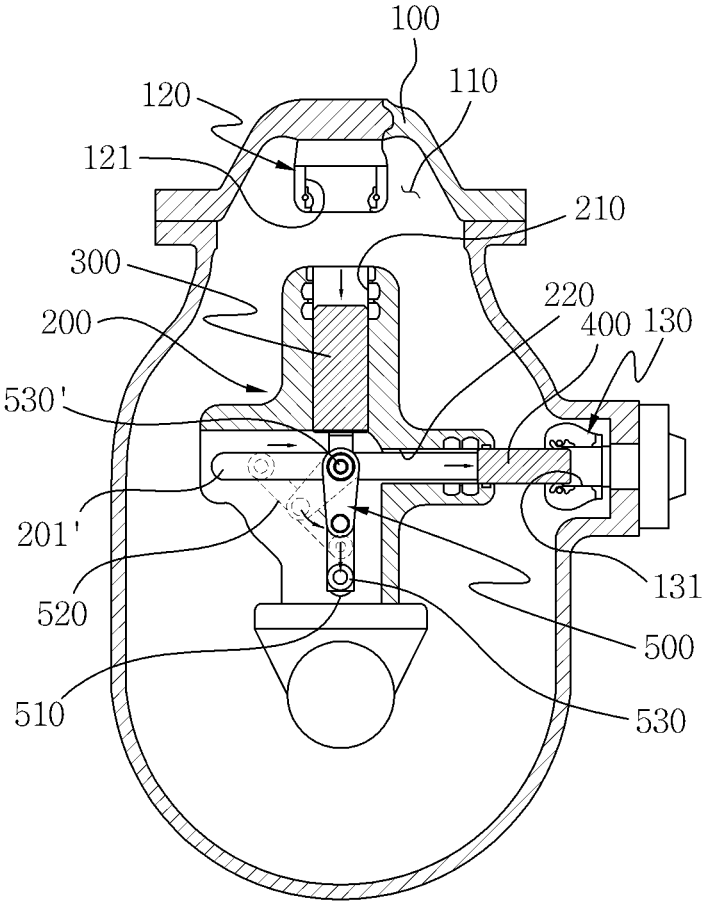
FIG. 4 is a second operating state diagram illustrating an earthing switch coupling state of the 3-way switch for the gas-insulated apparatus according to the present invention.

That is, the main lever 500 is maintained in a neutral position as illustrated in FIG. 2, or linearly slides the DS operating part 300 and the ES operating part 400 as in FIGS. 3 and 4.

On the other hand, the main lever 500 is coupled to one end of an insulation rod 600 which is connected to an external operating machine and transfers a turning force. Here, the insulation rod 600 has one end of an axial direction coupled to the main lever 500 in a state in which the one end is rotatably coupled to the support conductor 200 and the other end rotatably coupled in a state in which the other end has passed through outside the pressure container 100.

Hereinafter, an operation sequence of the 3-way switch for the gas-insulated apparatus according to the present invention will be described with reference to FIGS. 3 and 4.

First, an operation of the DS operating part 300 as in FIG. 3 will be described. When the insulation rod 600 connected to the outside in a neutral state is rotated at a given angle in a clockwise direction, the main lever 500 connected thereto is rotated, and the first connecting lever 510 rotatably connected to the main lever 500 allows the connecting roller 530 to be driven upwardly and linearly along a first groove 201 formed in the support conductor 200. The first groove 201 is formed in parallel with the first guide hole 210.

At this time, the first connecting lever 510 upwardly pushes the DS operating part 300, so that switching to a DS coupling state is performed. A DS opening operation is performed in opposite order.

Next, an operation of the ES operating part 400 as in FIG. 4 will be described. When the insulation rod 600 connected to the outside in the neutral state is rotated at a given angle in a counterclockwise direction, the main lever 500 connected thereto is rotated, and the second connecting lever 520 rotatably connected to the main lever 500 allows the second connecting roller 530' to be driven to the right side and linearly along a second groove 201' formed in the support conductor 200. The second groove 201' is formed in parallel with the second guide hole 220.

The first connecting lever 510 and the second connecting lever 520 are integrated with each other to be a single lever.

The first groove 201 and the second groove 201 are formed in perpendicular with each other.

At this time, the second connecting lever 520 pushes the ES operating part 400 to one side, so that switching to an ES coupling state is performed. An ES opening operation is performed in opposite order.

Consequently, according to the present invention, the main lever 500 which rotatably moves according to an external force switches an operating part to linear motion to achieve neutrality, disconnection switching, and earthing switching, thereby reducing a driving radius and size of a device.

Although the present invention for a 3-way switch for a gas-insulated apparatus has been described along with the accompanying drawings, this only illustrates preferred exemplary embodiments but not limits the scope of the present invention.

Accordingly, it will be apparent for those skilled in the art that various modifications and imitations of dimensions, shapes, structures, etc. may be made without departing from the spirit and scope of the present invention.

INDUSTRIAL APPLICABILITY

The present invention can be efficiently applied to a 3-way switch for a gas-insulated apparatus in which a main lever which rotatably moves according to an external force switches an operating part to linear motion to achieve neutrality, disconnection switching, and earthing switching, thereby reducing a driving radius and size of a device.

The invention claimed is:

1. A 3-way switch for a gas-insulated apparatus, comprising:

a pressure container having a space part therein, the pressure container including a first connecting part in an upper portion of the space part and a second connecting part in a side portion of the space part such that the second connecting part is perpendicular to the first connecting part;

a support conductor provided in the space part, the support conductor having a first guide hole and a second guide hole formed in perpendicular to the first guide hole;

a disconnecting switch (DS) operating part slidably disposed inside the first guide hole, the DS operating part being connected to or separated from the first connecting part by means of an insertion into or extrusion from the first connecting part;

an earthing switch (ES) operating part slidably disposed inside the second guide hole, the ES operating part being connected to or separated from the second connecting part through an insertion into or protrusion from the second connecting part;

a first groove linearly extended from the first guide hole, a first rotatable roller slidably disposed in the first groove and connected to the DS operating part to slidably and linearly move therewith, and a first connecting lever, one end of which is rotatably connected to the first rotatable roller;

a second groove linearly extended from the second guide hole, the second groove being perpendicular to the first groove, a second rotatable roller slidably disposed in the second groove and connected to the ES operating part to slidably and linearly move therewith, and a second connecting lever, one end of which is rotatably connected to the second rotatable roller, wherein the second connecting lever is integrated with the first connecting lever as a single lever; and a main lever, one end of which is rotatably coupled to the support conductor, and the other end of which is rotatably connected to both the other end of the first connecting lever and the other end of the second connecting lever.

2. The 3-way switch for the gas-insulated apparatus of claim 1, wherein, when the main lever rotates clockwise, the DS operating part and the first rotatable roller slidably and linearly move toward the first connecting part, and the ES operating part and the second rotatable roller slidably and linearly move away from the second connecting part, and wherein, when the main lever rotates counterclockwise, the ES operating part and the second rotatable roller slidably and linearly move toward the second connecting part, and the DS operating part and the first rotatable roller slidably and linearly move away from the first connecting part.

3. The 3-way switch for the gas-insulated apparatus of claim 1, wherein a rotation angle of the main lever is 90°.

4. The 3-way switch for the gas-insulated apparatus of claim 1, wherein the main lever is coupled to one end of an insulation rod which is connected to an external operating machine and transfers a turning force, and wherein the insulation rod has one end of an axial direction coupled to the main lever in a state in which the one end is rotatably coupled to the support conductor and the other end rotatably coupled in a state in which the other end has passed through outside the pressure container.

* * * * *